US009656489B2

(12) United States Patent
Kokuta

(10) Patent No.: US 9,656,489 B2
(45) Date of Patent: May 23, 2017

(54) PRINTER

(71) Applicant: SATO HOLDINGS KABUSHIKI KAISHA, Tokyo (JP)

(72) Inventor: Hiroshi Kokuta, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/125,718

(22) PCT Filed: Nov. 26, 2015

(86) PCT No.: PCT/JP2015/083259

§ 371 (c)(1),
(2) Date: Sep. 13, 2016

(87) PCT Pub. No.: WO2016/088647

PCT Pub. Date: Jun. 9, 2016

(65) Prior Publication Data

US 2017/0001457 A1 Jan. 5, 2017

(30) Foreign Application Priority Data

Dec. 3, 2014 (JP) ..... 2014-245215

(51) Int. Cl.
*B41J 15/04* (2006.01)
*B41J 15/16* (2006.01)

(52) U.S. Cl.
CPC ..... *B41J 15/048* (2013.01); *B41J 15/04* (2013.01); *B41J 15/16* (2013.01)

(58) Field of Classification Search
CPC ..... B41J 15/046; B41J 13/0009; B41J 13/00; B41J 15/044; B41J 15/04; B41J 15/00;
(Continued)

(56) References Cited

U.S. PATENT DOCUMENTS 6,622,622 B2 9/2003 Lee et al.
9,221,574 B2 * 12/2015 Sakaino ..... B41J 11/0095
(Continued)

FOREIGN PATENT DOCUMENTS

JP 62-50958 U 3/1987
JP 62-50959 U 3/1987
(Continued)

*Primary Examiner* — Kristal Feggins
(74) *Attorney, Agent, or Firm* — Foley & Lardner LLP

(57) ABSTRACT

A printer includes a medium supply unit, a printing unit, a feed unit, which feeds a print medium along a feed direction that is any one of a first direction toward the printing unit from the medium supply unit or a second direction toward the medium supply unit from the printing unit on a reference surface, a depressed portion, which is disposed using the reference surface as a reference, and a movement restricting portion, which includes a guide piece and restricts a movement of the print medium to a direction perpendicular to the feed direction of the print medium by housing at least a part of the guide piece in the depressed portion and abutting a side edge of the print medium on the guide piece, and a side edge on a side of the printing unit of the guide piece is disposed at a position close to an inner wall surface on the printing unit side of the depressed portion with respect to an inner wall surface on a side of the medium supply unit of the depressed portion.

4 Claims, 20 Drawing Sheets

(58) Field of Classification Search
CPC ..... B41J 15/048; B41J 15/16; B41J 11/42; B41J 11/0095
See application file for complete search history.

(56) References Cited

U.S. PATENT DOCUMENTS

| | | | | |
|---|---|---|---|---|
| 2005/0147450 | A1* | 7/2005 | Sugimoto | B41J 15/046 400/613 |
| 2013/0286140 | A1* | 10/2013 | Matsuda | B41J 2/325 347/218 |
| 2014/0002569 | A1* | 1/2014 | Yuno | B41J 13/0009 347/218 |
| 2014/0212198 | A1* | 7/2014 | Uchino | B41J 15/04 400/642 |

FOREIGN PATENT DOCUMENTS

| | | | |
|---|---|---|---|
| JP | 63-88651 | U | 6/1988 |
| JP | 5-51655 | U | 7/1993 |
| JP | 2003-246514 | A | 9/2003 |
| JP | 2005-238752 | A | 9/2005 |

* cited by examiner

PRINTER

TECHNICAL FIELD

The present invention relates to a printer, for example, a printer having a label printing function that prints desired information, such as a character, a sign, a diagram, a barcode, or similar information, on a print medium such as a label or a similar print medium.

BACKGROUND ART

A label printer is a printer having a label printing function that, for example, prints desired information on a label temporarily adhered on a rolled continuous paper in a rolled-shape.

A common label printer includes a paper sheet supply unit, which unwind a rolled continuous paper in a sheet-shape to feed the continuous paper, a thermal head, which prints information based on data generated by a computer or similar device on a label, a platen roller, which feeds the continuous paper, a damper, which biases the continuous paper, and a width adjustment guide, which guides the continuous paper by contacting a side edge in a width direction of the continuous paper.

Below this width adjustment guide, a bottom surface inside a chassis of a label printer chassis is formed in a flat-shape. A lower end portion of the width adjustment guide is terminated at the position not contacting the bottom surface inside the chassis.

It should be noted that, for example, JP63-88651U discloses, a technique for preventing an occurrence of paper jam caused by a curling of paper sheet in a paper sheet feeding mechanism.

SUMMARY OF INVENTION

Operations of a printer include a forward feeding and a back feeding.

The forward feeding is an operation to print information on a label. The forward feeding feeds a continuous paper to a direction toward a thermal head from a paper sheet supply unit. During the forward feeding, biasing force by a damper is balanced with tension of the continuous paper.

The back feeding is an operation, after a label on the continuous paper is printed with information on and is cut off, to wind back the continuous paper to print information on the next label of the label. During the back feeding, the continuous paper is fed to a direction toward the paper sheet supply unit from the thermal head.

During this back feeding, the paper sheet supply unit does not rotate but a platen roller rotates in an opposite direction from a rotation direction during the forward feeding, and the fed continuous paper deflects. Deflection of the fed continuous paper deprives the tension of the continuous paper, therefore the damper may no longer bias the continuous paper and the continuous paper may move away from the width adjustment guide (that is, the width adjustment guide does not abut on a side edge of the continuous paper P). As a result, the continuous paper may deviate from a range guided by the width adjustment guide (hereinafter referred to as a "guide range").

Forward feeding in a state where the continuous paper is out of the guide range causes deteriorated printing quality such as deviation of a printing position from a planned position.

It is an object of the present invention to provide a printer that prevents deterioration of printing quality caused by deflection of the continuous paper during a back feeding process.

A printer according to a first aspect of the present invention is a printer that includes a medium supply unit configured to supply a print medium, a printing unit configured to print predetermined information on the print medium, a feed unit configured to feed the print medium along a feed direction that is any one of a first direction toward the printing unit from the medium supply unit, and a second direction toward the medium supply unit from the printing unit, on a reference surface, a depressed portion disposed using the reference surface as a reference, and a movement restricting portion including a guide piece, the movement restricting portion being configured to restrict a movement of the print medium to a direction perpendicular to the feed direction of the print medium by housing at least a part of the guide piece in the depressed portion, and abutting a side edge of the print medium on the guide piece, wherein a side edge on a side of the printing unit of the guide piece is disposed at a position close to an inner wall surface on the printing unit side of the depressed portion with respect to an inner wall surface on a side of the medium supply unit of the depressed portion.

A printer according to a second aspect of the present invention is a printer according to the first aspect in which the side edge on the printing unit side of the guide piece abuts on the inner wall surface on the printing unit side of the depressed portion.

A printer according to a third aspect of the present invention is a printer according to the first or the second aspect further including a damper portion disposed between the printing unit and the medium supply unit, the damper portion being configured to give tension to the print medium, wherein the movement restricting portion is disposed in the damper portion.

A printer according to a fourth aspect of the present invention is a printer according to the third aspect in which the damper portion includes an inner damper portion, and a position where the inner damper portion abuts on the print medium is positioned on a downstream side with respect to a position of the depressed portion in the first direction.

According to the above-described aspects, deterioration of printing quality caused by deflection of the continuous paper during the back feeding process is preventable.

DESCRIPTION OF EMBODIMENTS

Figure 1:
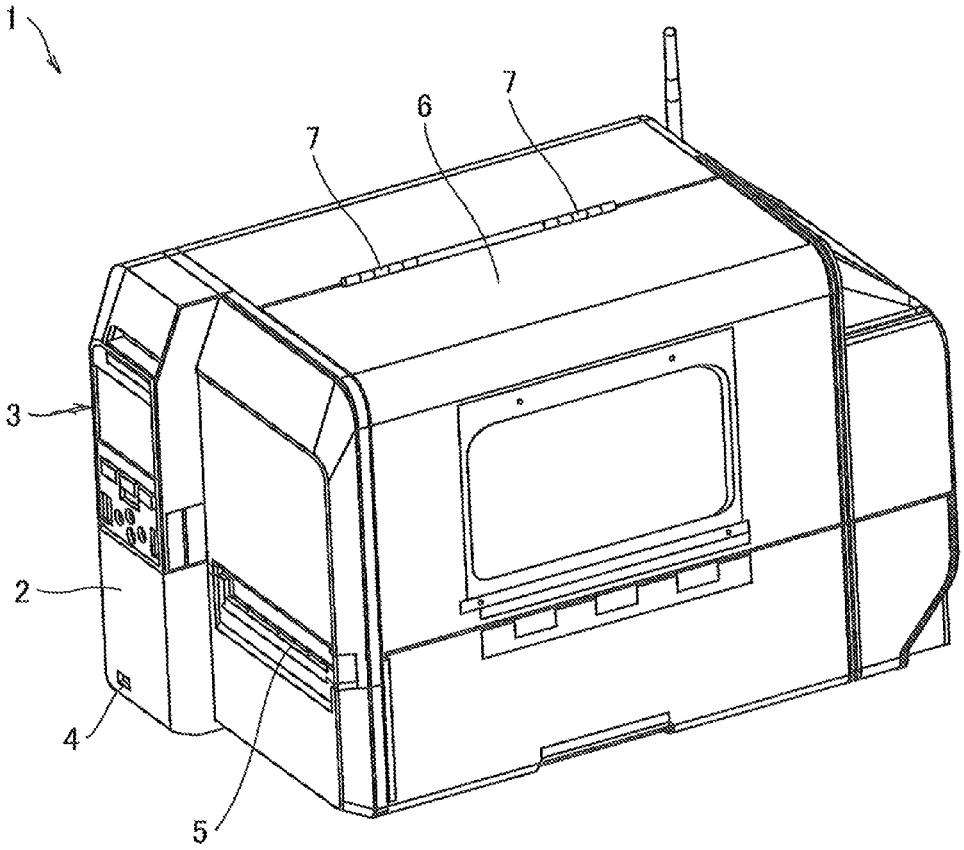
FIG. 1 is an overall perspective view of an appearance of a printer according to an embodiment of the present invention.

The following describes an embodiment of the present invention in detail on the basis of the drawings. It should be noted that in the drawings, an identical reference numeral is basically attached to an identical component, and its repeated similar description is omitted.

Hereinafter, a direction toward a printing unit from a paper sheet supply unit (a first direction) or a direction toward the paper sheet supply unit from the printing unit (a second direction) is referred to as a "feed direction." Unless otherwise described, a side of the paper sheet supply unit is referred to as an "upstream side" and a side of the printing unit is referred to as a "downstream side."

(1-1) Appearance of a Printer (FIG. 1)

An appearance of a printer according to an embodiment is described with reference to FIG. 1. FIG. 1 is an overall perspective view of an appearance of a printer according to an embodiment of the present invention.

A printer 1 according to the embodiment is, for example, a label printer having a label printing function that prints desired information (such as a character, a sign, a diagram, a barcode, or their combinations) on a label temporarily adhered on a liner sheet constituting a continuous paper.

As illustrated in FIG. 1, the printer 1 includes a front cover 2 at its front side. The front cover 2 includes an operational panel 3, a power switch 4 and an issue port (medium discharging portion) 5.

The operational panel 3 includes an LCD (Liquid Crystal Display), which displays a message or similar information, a plurality of keys (such as a line key, a feed key, a function key, a direction indicating key and a cancel key), which are operated when a user gives an instruction to the printer 1, and a plurality of LEDs (Light Emitting Diodes), which emit lights corresponding to a state of the printer 1.

One side surface of the printer 1 includes an open cover 6. The open cover 6 mounts on the one side surface of the printer 1 in a state openable/closable in a vertical direction by hinges 7 at two positions.

Figure 2:
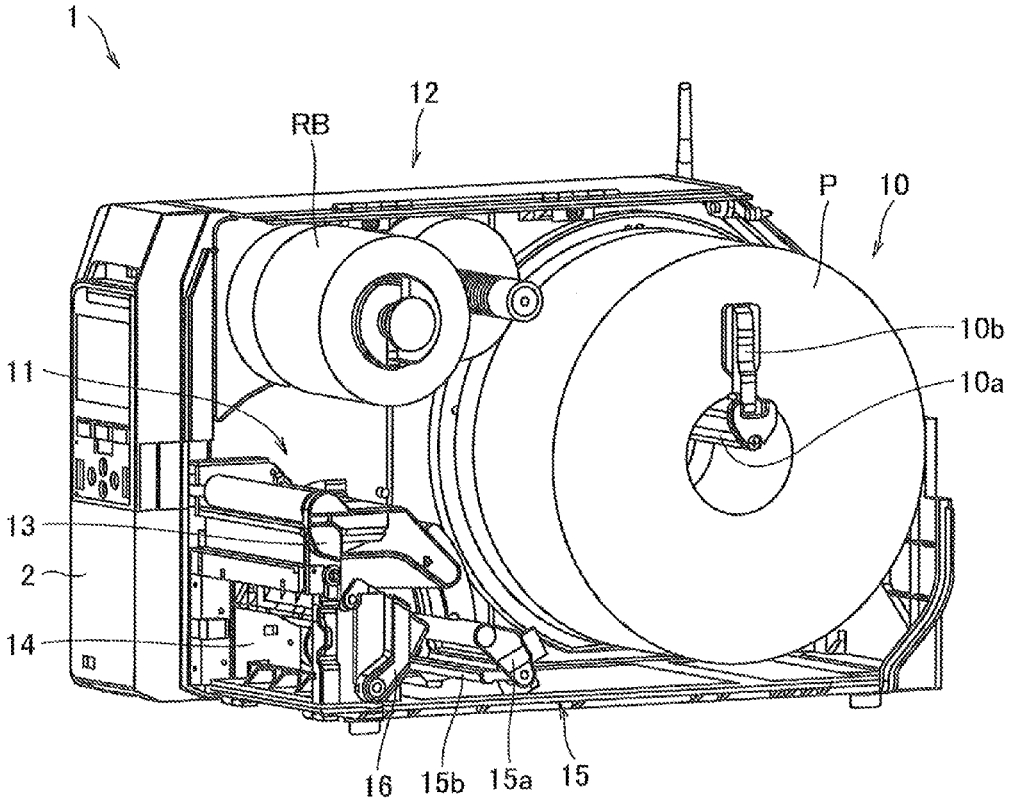
FIG. 2 is a perspective view for illustrating an inside of the printer in FIG. 1.
Figure 3:
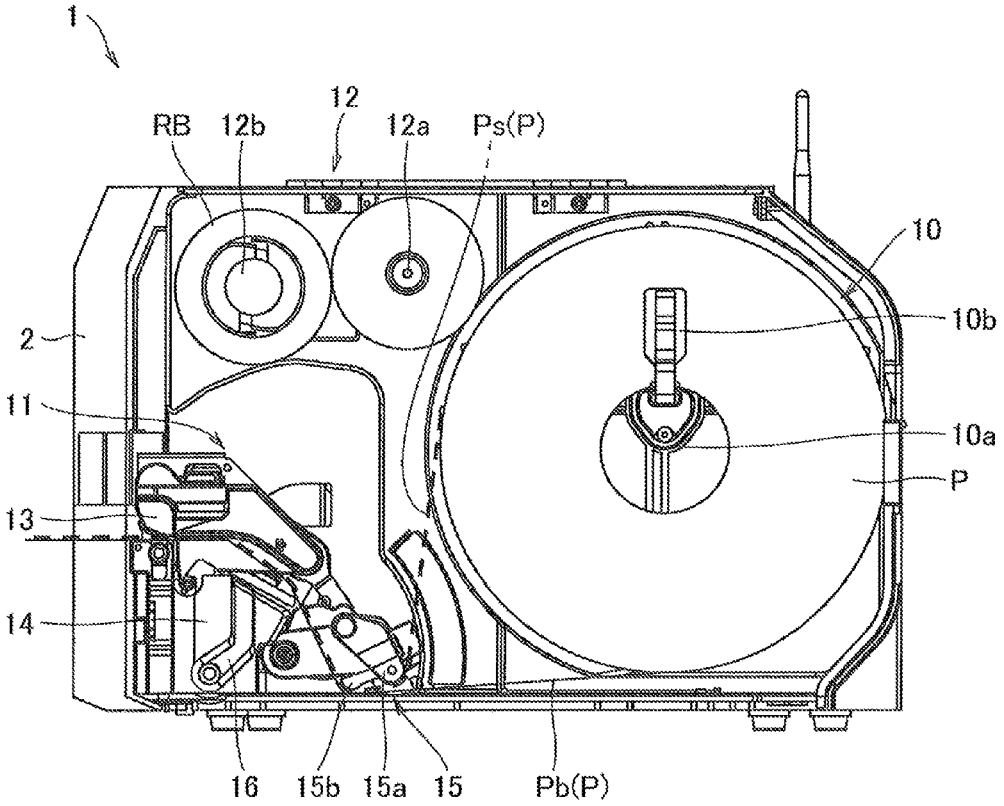
FIG. 3 is a perspective view for illustrating a side surface of the printer in FIG. 2.

(1-2) Internal Structure of the Printer (FIG. 2 to FIG. 3)

An internal structure of the printer 1 is described with reference to FIG. 2 and FIG. 3. FIG. 2 is a perspective view for illustrating an inside of the printer in FIG. 1. FIG. 3 is a perspective view for illustrating a side surface of the printer in FIG. 2.

It should be noted that in the following description, a front side of the printer 1 (a side of the front cover 2) is referred to as a "front" or a "downstream side," and a back side which is an opposite side to the front side of the printer 1 (a side of a back cover (not illustrated)) is referred to as a "rear" or an "upstream side."

As illustrated in FIG. 2, the printer 1 internally includes a paper sheet supply unit (a medium supply unit) 10, which is disposed in the rear, a printing unit 11, which is disposed in the front, and an ink ribbon portion 12, which is disposed in the upper side.

The paper sheet supply unit 10 is configured to supply a continuous paper (a print medium) P to the printing unit 11. The paper sheet supply unit 10 includes a support shaft 10*a*, and a roll guide 10*b*, which is disposed at one end of the support shaft 10*a*.

The support shaft 10*a* is configured to support the roll-shaped continuous paper P set in the paper sheet supply unit 10 in a rotatable state.

The roll guide 10*b* is configured to guide a side edge of the roll-shaped continuous paper P set in the paper sheet supply unit 10. The roll guide 10*b* is movable along an axial direction of the support shaft 10*a* in order to change its position corresponding to a width of the continuous paper P.

The continuous paper P, for example, has a liner sheet of a long shape and a plurality of labels temporarily adhered at every predetermined interval along a longitudinal direction of the liner sheet.

A surface where an adhesive surface of the label contacts on the liner sheet (hereinafter referred to as a "printed surface") has a releasing agent (such as silicone) coated. With this, a user can peel off the label easily from the liner sheet.

On a surface where the adhesive surface of the label does not contact on the liner sheet (that is, an opposite side surface to the printed surface), position detection marks, which indicate positions of the labels temporarily adhered on the printed surface, are formed at every predetermined interval along the longitudinal direction of the liner sheet.

The label may be a thermal paper or a plain paper. In a case where the label is the thermal paper, a thermal coloring layer, which develops a specific color (such as black and red) upon reaching a predetermined temperature region, is formed on the label surface.

The continuous paper P may be an outside wound label or an inside wound label. In a case of the outside wound label, the continuous paper P is wound around such that the label is positioned an outer peripheral surface when in a rolled-shape. In this case, as illustrated in FIG. 3, the continuous paper Ps (P: dashed line) is unwound to be fed approximately from a center of the paper sheet supply unit 10 in the vertical direction toward a bottom portion of the printing unit 11.

In contrast to this, in a case of the inside wound label, the continuous paper P is wound around such that the label is positioned on an inner peripheral surface when in a rolled-shape. In this case, as illustrated in FIG. 3, the continuous paper Pb (P: the solid line) is unwound to be fed approximately from a bottom surface inside the chassis of the printer 1 toward the bottom portion of the printing unit 11.

It should be noted that for both the outside wound label and the inside wound label, a paper passing route of the continuous paper P (Ps, Pb) in the printing unit 11 are identical.

For both the outside wound label and the inside wound label, the continuous paper P is fed in a state where the printed surface where the label is temporarily adhered faces upward.

The printing unit 11 is configured to print predetermined information on the label. The printing unit 11 includes a printing head 13, a supporting stand 14, which is disposed below the printing head 13 and a damper portion 15, which is disposed at a rear (upstream side in a printing direction) of the printing head 13 and the supporting stand 14.

The printing head 13 is disposed inside the printer 1 in an openable/closable state as described below. When the printing head 13 is in a closed state, the paper passing route (medium feed path) of the continuous paper P is formed between the printing head 13 and the supporting stand 14. The paper passing route communicates to the issue port 5 (see FIG. 1).

The supporting stand 14 includes a head lock lever 16, which maintains the closed state of the printing head 13. When a user operates this head lock lever 16, the closed state of the printing head 13 is released, and a front portion of the printing head 13 is lifted up to open the printing head 13. This separates the printing head 13 from a platen roller 23 which will be described later.

The damper portion 15 is configured to bias the continuous paper P in order to be balanced with tension of the continuous paper P. The damper portion 15 includes an outer damper 15*a* and an inner damper 15*b*. The damper portion 15 is configured to move in the vertical direction (open and close) in conjunction with opening and closing of the printing head 13.

The outer damper 15*a* and the inner damper 15*b* are each disposed in a swingable state such that the printing head 13 can bias the continuous paper P in the closed state.

The ink ribbon portion 12 is configured to perform supply and recovery of an ink ribbon RB, on which a printing ink is applied. The ink ribbon portion 12 includes a ribbon supply unit 12*a* and a ribbon roll up unit 12*b*, which is disposed at a front neighboring the ribbon supply unit 12*a*.

The ribbon supply unit 12*a* is configured to support the ink ribbon RB rolled up in a roll-shape in a rotatable state.

The ribbon roll up unit 12*b* rolls up the used ink ribbon RB which is extracted from the ribbon supply unit 12*a* and passed below the printing head 13 for recovery.

The continuous paper P unwound to be fed in a sheet-shaped from the paper sheet supply unit 10 is inserted through the paper passing route between the printing head 13 and the supporting stand 14 via the damper portion 15. Once the continuous paper P is inserted through the paper passing route, after desired information is printed on the label or similar medium of the continuous paper P, the continuous paper P is discharged to an outside of the printer 1 from the issue port 5.

(1-3) Configuration of the Printing Unit (FIG. 4 to FIG. 9)

Figure 4:
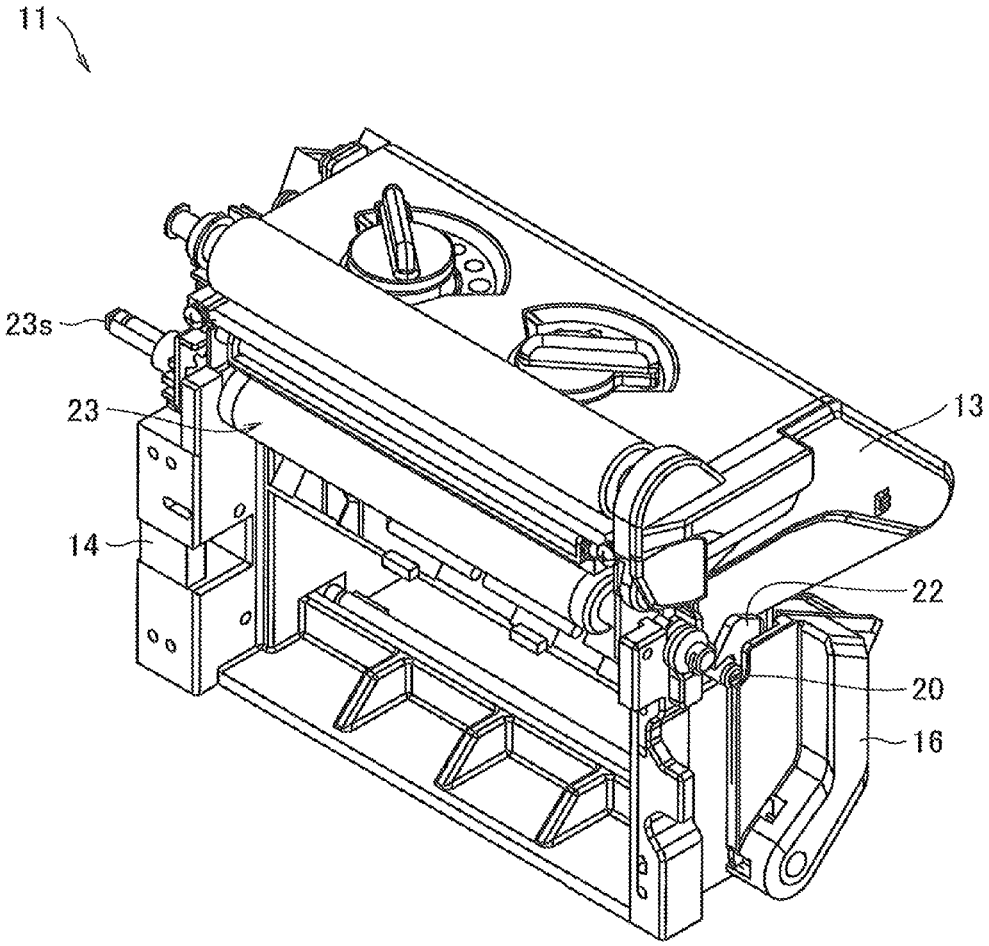
FIG. 4 is an enlarged perspective view where a printing unit in FIG. 3 is viewed from a front.
Figure 5:
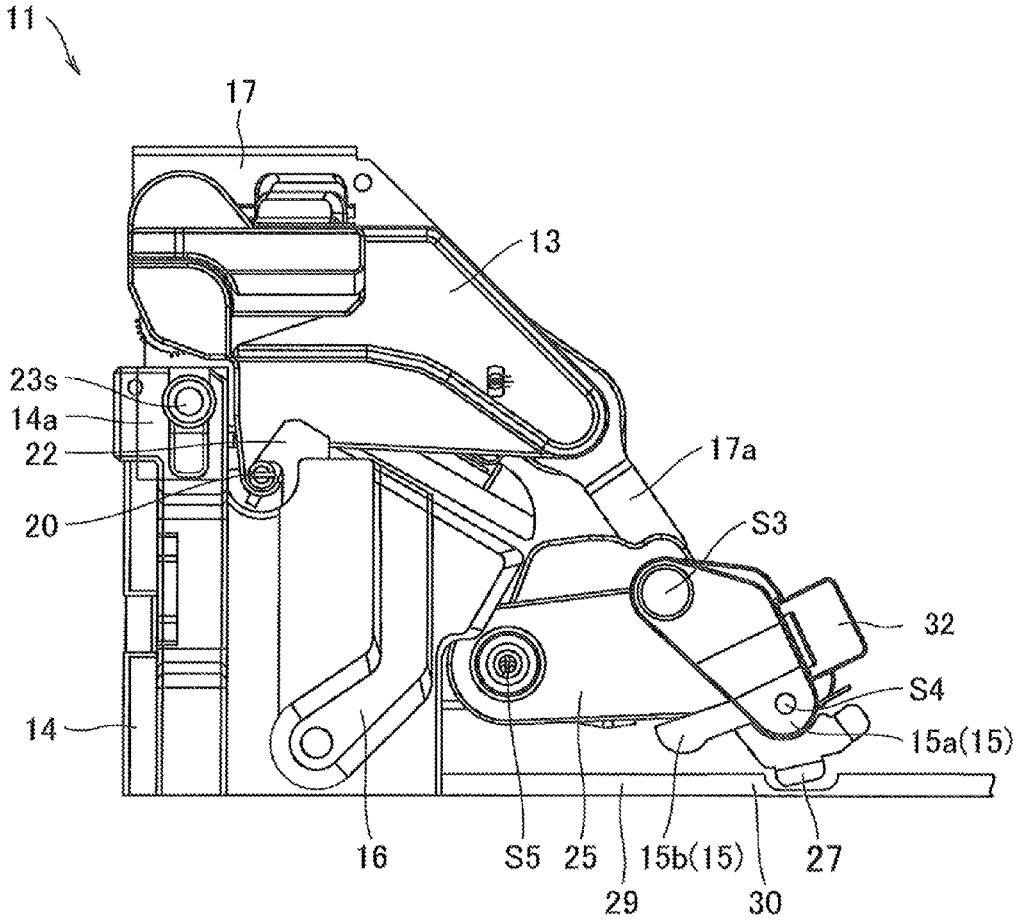
FIG. 5 is a side view of the printing unit in FIG. 4.
Figure 6:
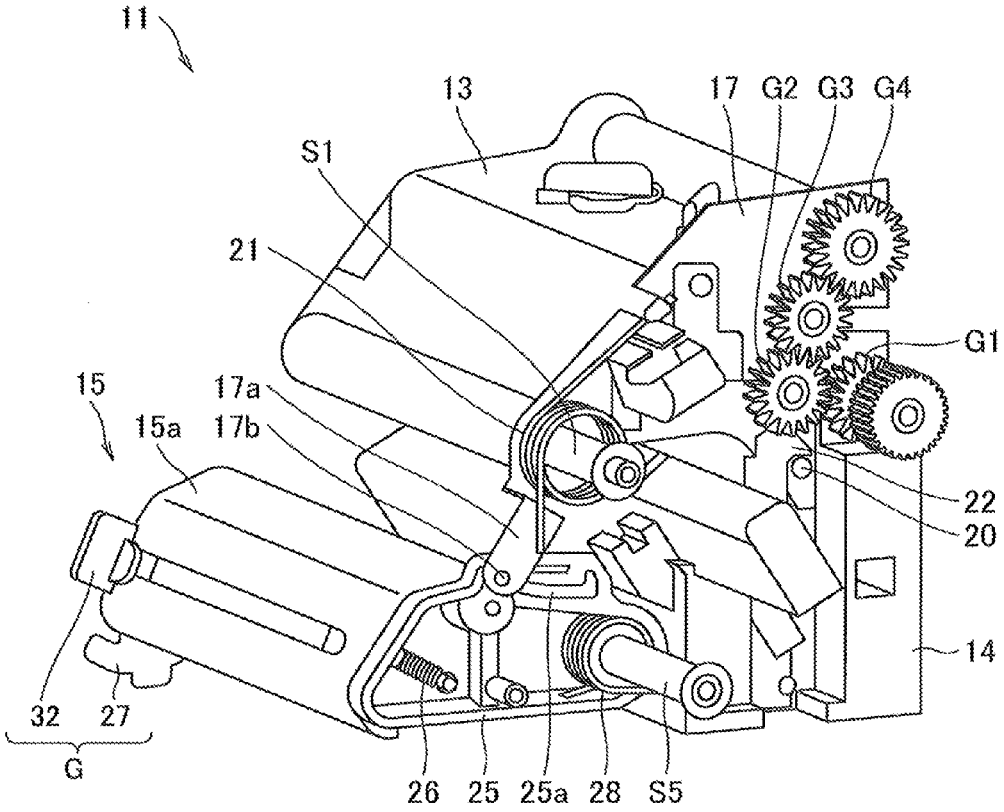
FIG. 6 is a perspective view of the printing unit in FIG. 4 viewed from a back side.
Figure 7A:
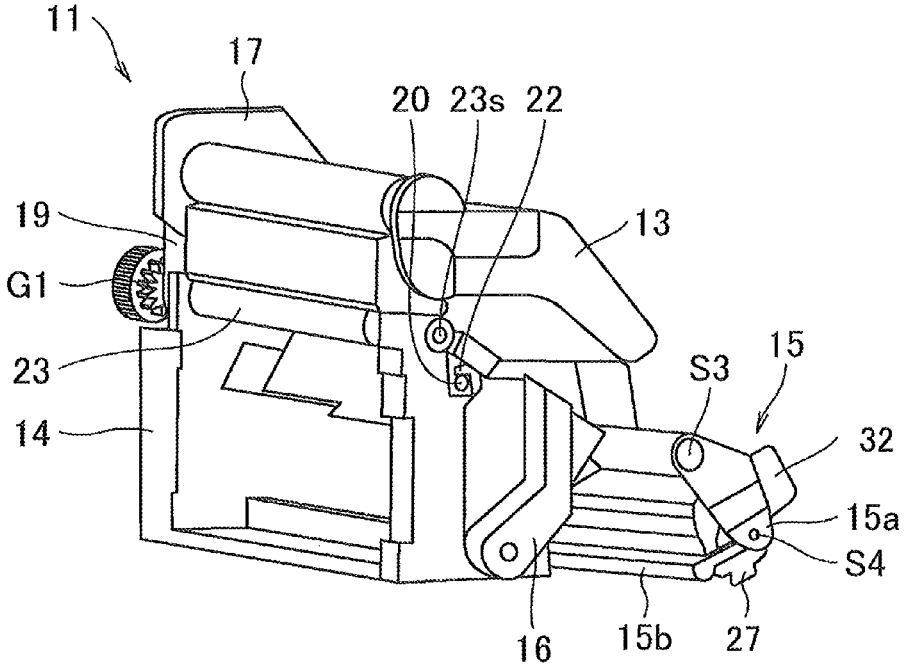
FIG. 7A is a perspective view viewing the printing unit when a printing head in FIG. 4 is in a closed state from the front.
Figure 7B:
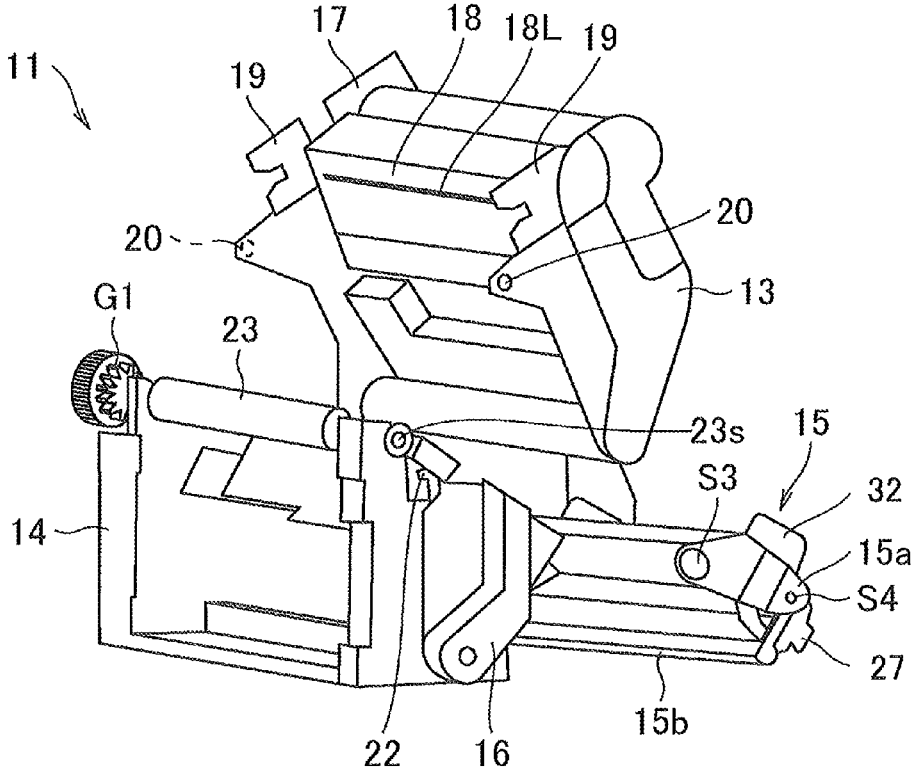
FIG. 7B is a perspective view viewing the printing unit when the printing head in FIG. 4 is in an open state from the front.
Figure 8:
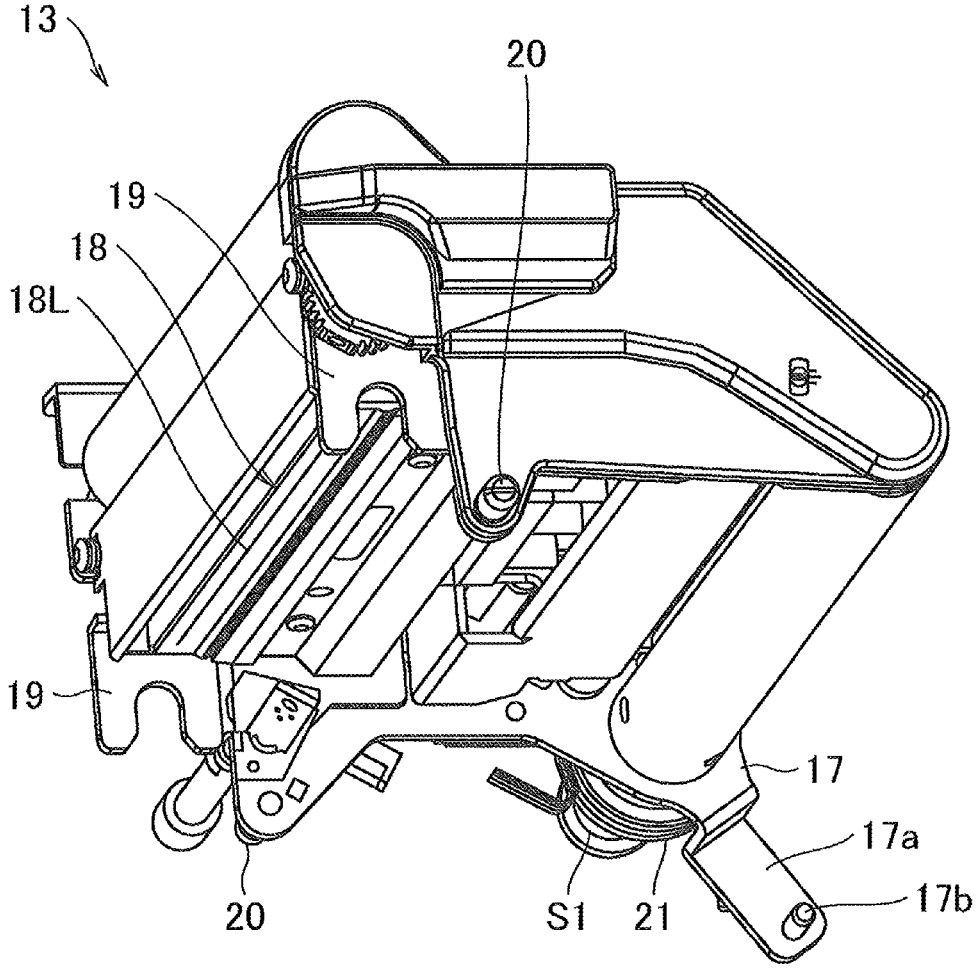
FIG. 8 is a perspective view where the printing head in FIG. 4 is extracted and viewed from a lower side.
Figure 9:
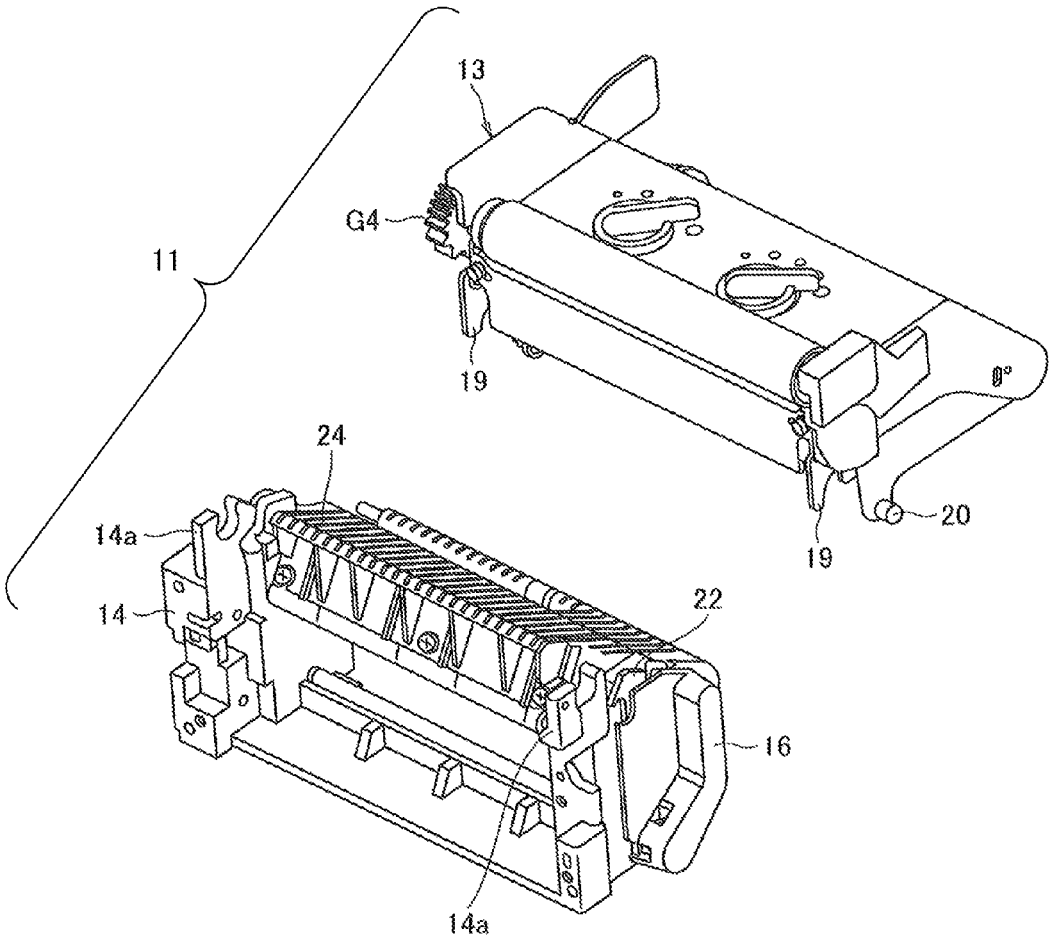
FIG. 9 is an exploded perspective view of the printing unit in FIG. 4.

A configuration of the printing unit 11 is described with reference to FIG. 4 to FIG. 9. FIG. 4 is an enlarged perspective view where a printing unit in FIG. 3 is viewed from a front. FIG. 5 is a side view of the printing unit in FIG. 4. FIG. 6 is a perspective view of the printing unit in FIG. 4 viewed from a back side. FIG. 7A is a perspective view viewing the printing unit when a printing head in FIG. 4 is in the closed state from the front, and FIG. 7B is a perspective view viewing the printing unit when the printing head in FIG. 4 is in an open state from the front. FIG. 8 is a perspective view where the printing head in FIG. 4 is extracted and viewed from a lower side. FIG. 9 is an exploded perspective view of the printing unit in FIG. 4.

One side surface of the printing head 13, which constitutes the printing unit 11, includes a head support plate 17, which supports the printing head 13. The head support plate 17 is supported in a state swingable around a rotary shaft S1 (see FIG. 6 and FIG. 8). This supports a front portion of the printing head 13 in a state swingable in the vertical direction (that is, open and close) around the rotary shaft S1 at the rear.

An end portion on a side of the damper portion 15 in the head support plate 17 (an opposite position of a front portion of the head support plate 17 with respect to the rotary shaft S1) has a suppression portion 17*a* (see FIG. 5, FIG. 6 and FIG. 8) formed integrally. On an end side of the suppression portion 17*a*, a surface that faces the damper portion 15 includes a pin 17*b* (see FIG. 6 and FIG. 8) projecting from the surface.

The printing head 13 includes a thermal head 18 (see FIG. 7B and FIG. 8). The thermal head 18 is disposed on an inferior surface of the printing head 13 in a state where a printing surface of the thermal head 18 is facing the paper passing route. The printing surface of the thermal head 18 includes a printing line 18L.

The printing line 18L includes a plurality of heating resistors (heating elements) disposed aligning along a direction perpendicular to the feed direction of the continuous paper P (hereinafter, referred to as a "width direction"). The heating resistors generate heat by energization. The thermal head 18 is one example of printing means for printing information on the label of the continuous paper P or similar medium using the heating resistors on the printing line 18L.

The inferior surface on a front side of the printing head 13 includes one pair of depressed claw portions 19 (see FIG. 7B and FIG. 8) sandwiching the thermal head 18.

At a rear of the depressed claw portions 19 on the inferior surface of the printing head 13 includes one pair of pins 20 projecting outside of both side surfaces of the printing head 13.

The printing head 13 includes a torsion spring 21 on the rotary shaft S1 (see FIG. 6 and FIG. 8). The torsion spring 21 is configured to bias the printing head 13 to the opening direction.

The supporting stand 14 includes one pair of lock claw portions 22. When the lock claw portions 22 engage the pins 20 disposed on the inferior surface of the printing head 13, the closed state of the printing head 13 is maintained.

The lock claw portions 22 is configured to disengage from the pins 20 by moving rightward in FIG. 5 in conjunction with a user pulling the head lock lever 16 rightward in FIG. 5. When the lock claw portions 22 disengage from the pins 20, the printing head 13 is configured to open by biasing force of the torsion spring 21 as illustrated in FIG. 7B.

When the printing head 13 is in the closed state, the depressed claw portions 19 (see FIG. 7B and FIG. 8) of the printing head 13 is fit to both end parts of a platen shaft 23*s* (see FIG. 4, FIG. 7 and FIG. 5) of the platen roller 23. The depressed claw portions 19 are configured such that the printing surface of the thermal head 18 pressed onto the platen roller 23 (see FIG. 4 and FIG. 7) by a pressing device (not illustrated) disposed in the printing head 13.

The platen roller 23 is one example of the feed unit that feeds the continuous paper P to a direction to the printing unit 11 from the paper sheet supply unit 10 (the first direction) during a forward feeding process, and feeds the continuous paper P to a direction to the paper sheet supply unit 10 from the printing unit 11 (the second direction) during a back feeding process. The platen roller 23 is supported by a support frame 14*a* (see FIG. 5 and FIG. 9) of the supporting stand 14 in a state rotatable in a normal direction and a reverse direction. The platen roller 23 rotates in the normal direction during the forward feeding, and rotates in the reverse direction during the back feeding.

One end of the platen shaft 23*s* of the platen roller 23 in the axial direction is connected to a gear G1 (see FIG. 6 and FIG. 7B). The platen shaft 23*s* on a side of this gear G1 is engaged to a rotary shaft of a driver (such as a stepping motor) via, for example, a timing belt (not illustrated). The gear G1 is connected to a gear G4 via concatenation gears G2 and G3 (see FIG. 6).

On the upstream side in the printing direction on a top surface of the supporting stand 14, a paper sheet guide 24 is disposed to guide feeding of the continuous paper P (see FIG. 9). A top surface height of this paper sheet guide 24 is inclined in order to get higher toward the downstream side from the upstream side.

On the top surface of the paper sheet guide 24, protrusions extending along the feed direction of the continuous paper P is disposed at every predetermined interval along the width direction of the continuous paper P. This ensures the reduced contact area between the paper sheet guide 24 and the continuous paper P, thereby feeding the continuous paper P properly.

This also ensures the proper feeding of the continuous paper P, even in a case where the continuous paper P is temporarily adhered with a label with the adhesive exposed (hereinafter referred to as a "linerless label") is used.

It should be noted that a shape of the protrusions on the top surface of the paper sheet guide 24 is not limited to the shape extending to the feed direction of the continuous paper P, and it may be in a dotted manner.

In the paper passing route of the printing unit 11, a paper sheet position detecting sensor (not illustrated) is disposed between the thermal head 18 and the damper portion 15. This paper sheet position detecting sensor is configured to identify the position of the label of the continuous paper P by detecting at least one of the position detection marks formed on the continuous paper P and the liner sheet portions between the neighboring labels. The paper sheet position detecting sensor is, for example, a sensor of a light reflection type or a light transmission type.

The printing unit 11 feeds the continuous paper P by rotating the platen roller 23 in a state where the thermal head 18 is pressed onto a side of the platen roller 23, and the continuous paper P is sandwiched between the thermal head 18 and the platen roller 23, during a printing process. Then, the heating resistors of the printing line 18L are selectively heated in accordance with a printing signal transmitted to the thermal head 18 at a timing on the basis of information detected by the paper sheet position detecting sensor. This ensures printing of desired information (such as a character, a sign, a diagram, a barcode, or their combinations) on the label of the continuous paper P while feeding the continuous paper P.

Next, the damper portion 15 disposed on the printing unit 11 will be described.

As illustrated in FIG. 6, the damper portion 15 includes a damper supporting member 25 and a coil spring 26.

The damper supporting member 25 is configured to support the outer damper 15*a*. When the printing unit 11 is viewed from a side surface, the outer damper 15*a* extends obliquely downward from the front side toward the rear side, and the rear portion is supported by the damper supporting member 25 in a state swingable in the vertical direction around a rotary shaft S3 (see FIG. 5 and FIG. 7) on the front side.

The coil spring 26 is configured to restrain the outer damper 15*a* from moving too far to an upper side (rear side), and to support the outer damper 15*a* in the swingable state.

The outer damper 15*a* includes a guide mechanism G. The guide mechanism G includes a width adjustment guide (one example of a guide piece) 27 and a guide operating portion 32. The guide mechanism G is one example of a movement restricting portion which restricts movement of the continuous paper P to the width direction, which is perpendicular to the feed direction of the continuous paper P, by abutting the side edge of the continuous paper P to the width adjustment guide 27.

The width adjustment guide 27 is configured to restrict movement of the continuous paper P to the width direction by abutting the side edge on one side in the width direction of the continuous paper P fed from the paper sheet supply unit 10. The width adjustment guide 27 is disposed on a lower portion of the outer damper 15*a* in a state movable along the axial direction of the rotary shaft S3 and the rotary shaft S4.

The guide operating portion 32 is a tab configured to move the width adjustment guide 27 in accordance with the width of the continuous paper P, and to fix a position of the width adjustment guide 27. The guide operating portion 32 is connected to the width adjustment guide 27, and disposed on a back side of the outer damper 15*a* in a state movable along the axial direction of the rotary shaft S3 and the rotary shaft S4.

The damper supporting member 25 is supported inside the printer 1 in a state where the rear portion is swingable in the vertical direction around a rotary shaft S5 (see FIG. 5 and FIG. 6) on the front portion side. On the upper portion of this damper supporting member 25, a long groove portion (a guide portion) 25*a* (see FIG. 6) which extends along the longitudinal direction of the damper supporting member 25 is formed. In this long groove portion 25*a*, the pin 17*b* of the head support plate 17 is fitted in a state movable along the long groove portion 25*a*. This engages the damper supporting member 25 with the head support plate 17.

The damper supporting member 25 includes a torsion spring 28. A rear portion of the torsion spring 28 is coupled to the rotary shaft S5. The torsion spring 28 is configured to bias the damper supporting member 25 to a direction opening upward (a direction to which the whole damper portion 15 moves up) around the rotary shaft S5 (see FIG. 5 and FIG.

6). While the suppression portion 17*a* of the head support plate 17 is positioned at a suppression position (the outer damper 15*a* side), the damper supporting member 25 is suppressed by the suppression portion 17*a* and maintained in a closed state by the torsion spring 28 biasing the damper supporting member 25. This ensures the damper portion 15 to move (open and close) in the vertical direction in conjunction with opening and closing of the printing head 13.

That is, opening the printing head 13 moves the suppression portion 17*a* to a suppression release position (the rotary shaft S5 side) from the suppression position (the outer damper 15*a* side) along the long groove portion 25*a*. Consequently, the suppression against an opening movement of the damper supporting member 25 is released, and the damper portion 15 rises. This widens a width where the continuous paper P is inserted, and improves a visibility of the lower portion of the damper portion 15. In view of this, the continuous paper P extracted from the paper sheet supply unit 10 can be passed through below the damper portion 15 easily without being caught by the width adjustment guide 27. Accordingly, the operation of inserting the continuous paper P through the paper passing route in the printer 1 can be facilitated.

On the other hand, closing the printing head 13 moves the suppression portion 17*a* to the suppression position from the suppression release position along the long groove portion 25*a*. Consequently, the damper portion 15 moves down to the original height in conjunction with the movement of the suppression portion 17*a*. This can prevent the damper portion 15 from being left open. In view of this, a failure to print in a state where tension is not biased to the continuous paper P can be prevented.

A sequence of inserting operation of the continuous paper P can be facilitated.

Furthermore, a structure of the printer 1 can be simplified, and the number of components for the printer 1 can be reduced because a mechanism for opening the damper portion 15 manually is no longer necessary, and the printing head 13 and the suppression portion 17*a* double as an opening mechanism and a closing mechanism of the damper portion 15. In view of this, the cost of the printer 1 can be reduced, and the downsizing of the printer 1 can be promoted.

The opening and closing mechanism of the damper portion 15 is not limited to the above-described configuration, and, for example, the following configuration may be employed.

The damper supporting member 25 may be biased to a direction to close (a direction to which the whole damper portion 15 moves down) around the rotary shaft S5 by the torsion spring 28 whose rear portion is mounted on the rotary shaft S5. In this case, opening the printing head 13 moves the suppression portion 17*a* to the suppression release position from the suppression position along the long groove portion 25*a*. Consequently, the rear portion of the damper supporting member 25 is pulled upward in conjunction with the movement of the suppression portion 17*a*. This opens the rear portion of the damper portion 15 in conjunction with the opening movement of the printing head 13.

On the other hand, when the printing head 13 is closed, the rear portion of the damper supporting member 25 is configured to move down by the effect of the torsion spring 28 as the suppression portion 17*a* moves to the suppression position from the suppression release position along the long groove portion 25*a*. Consequently, the rear portion of the damper portion 15 closes in conjunction with the closing movement of the printing head 13.

In this case, the biasing force of the torsion spring 21 on a side of the printing head 13 is set to be larger than the biasing force of the torsion spring 28 on a side of the damper supporting member 25.

The inner damper 15*b*, which constitutes such damper portion 15, extends obliquely downward from the rear side toward the front side, contrary to the outer damper 15*a*, when viewed from the side surface of the printing unit 11 portion, and the front portion is supported by the rear portion of the outer damper 15*a* in a state swingable in the vertical direction around the rotary shaft S4 (see FIG. 5 and FIG. 7) on the rear side.

During the printing process, a paper sheet contact portion of the inner damper 15*b* is positioned downstream side of the continuous paper P with respect to the paper sheet contact portion of the outer damper 15*a*. That is, the paper sheet contact portion of the inner damper 15*b* is arranged between the printing head 13 and the paper sheet contact portion of the outer damper 15*a*.

Before the paper passing process, the height of the paper sheet contact portion of the inner damper 15*b* is arranged to a low position with respect to the height of the paper sheet contact portion of the outer damper 15*a*. That is, the height of the paper sheet contact portion of the inner damper 15*b* is arranged between the paper sheet contact portion of the outer damper 15*a* and the bottom surface inside the chassis of the printer 1.

Disposing such inner damper 15*b* can insert the continuous paper Pb through the paper passing route in a state where the continuous paper Pb contacts the inner damper 15*b*, even in a case of the inside wound label. In view of this, the continuous paper Pb can be biased by the inner damper 15*b* even in a case of the inside wound label. This feeds the continuous paper Pb properly, and prevents deterioration of the printing quality.

Supporting the inner damper 15*b* by the rotary shaft S4 of the outer damper 15*a* can bias the continuous paper P even in a case of the inside wound label without increasing the size of the printer 1.

(1-4 ) Structure Inside the Printer Chassis (FIG. 10 to FIG. 16)

Figure 10:
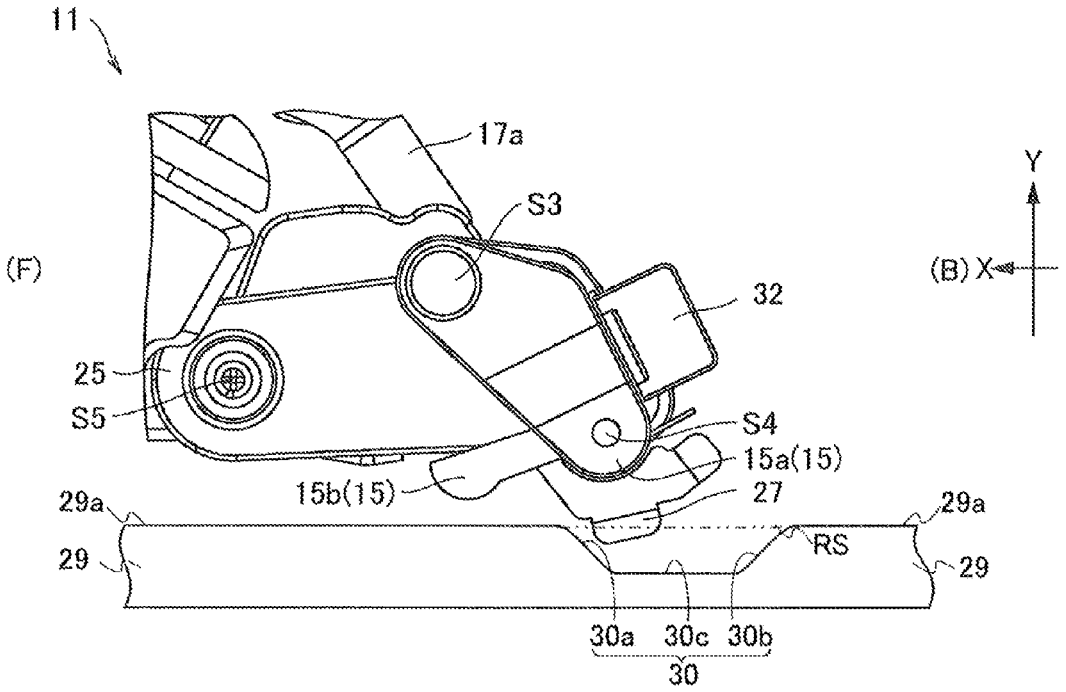
FIG. 10 is a main part enlarged side view of a damper in FIG. 5.
Figure 11:
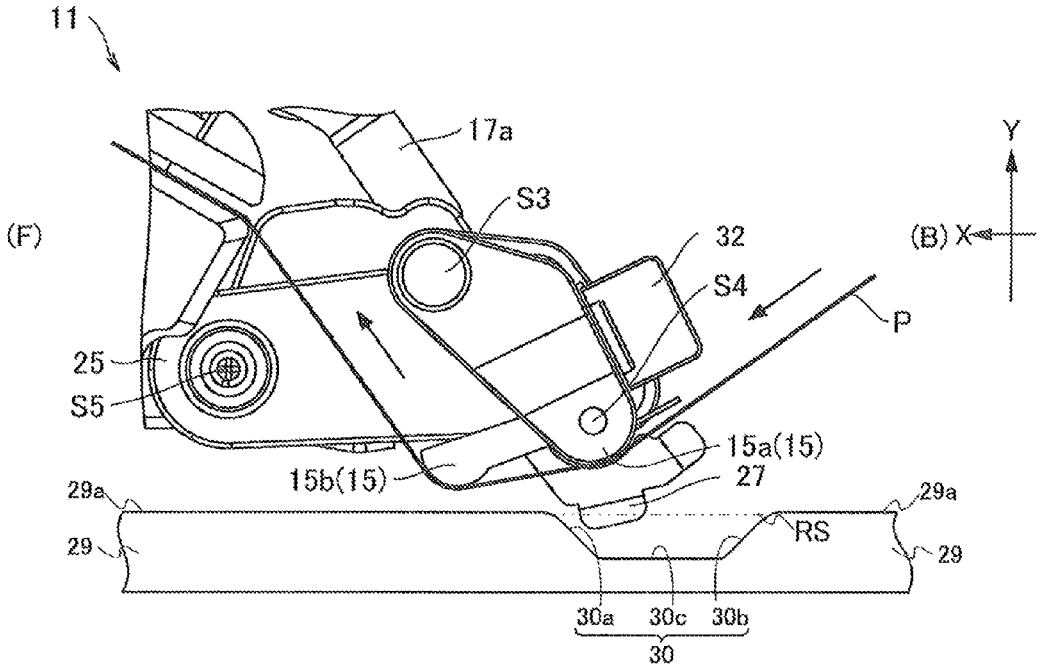
FIG. 11 is a main part enlarged side view of the damper in FIG. 10 during a printing process.
Figure 12:
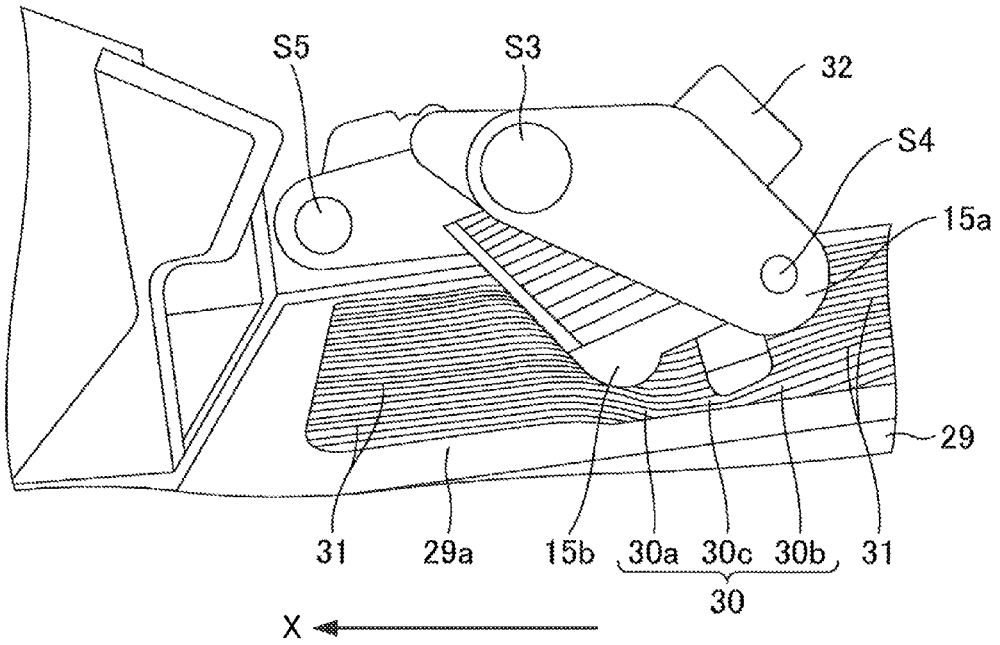
FIG. 12 is a main part perspective view of the damper in FIG. 10.
Figure 13:
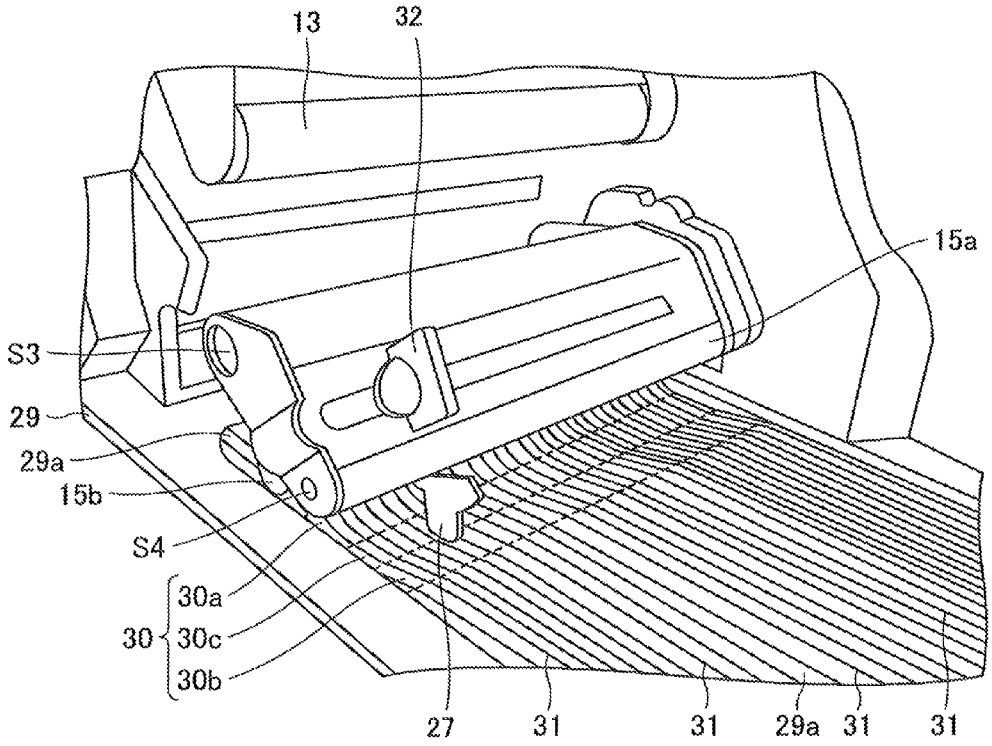
FIG. 13 is a main part perspective view of the damper and its peripheral area when the printing unit in FIG. 4 is viewed from the back side.

A positional relation of a depressed portion 30 (FIG. 5) which is formed inside the chassis of the printer 1 and the width adjustment guide 27 will be described with reference to FIG. 10 to FIG. 16. FIG. 10 is a main part enlarged side view of the damper in FIG. 5. FIG. 11 is a main part enlarged side view of the damper in FIG. 10 during a printing process. FIG. 12 is a main part perspective view of the damper in FIG. 10. FIG. 13 is a main part perspective view of the damper and its peripheral area when the printing unit in FIG. 4 is viewed from the back side. FIG. 14A to FIG. 16 each are main part enlarged views for illustrating one example of a positional relation between the width adjustment guide and the depressed portion in FIG. 10.

As illustrated in FIG. 10, a bottom portion 29 inside the chassis of the printer is configured with a bottom surface 29*a* and the depressed portion 30.

In terms of the vertical direction (Y direction in FIG. 10), a position of the bottom surface 29*a* corresponds to a surface for a reference (hereinafter referred to as a "reference surface") RS of a feeding height when feeding the continuous paper P. It should be noted that, during the forward feeding, the continuous paper P is fed to pass through a high position in the vertical direction with respect to the reference surface.

The depressed portion 30 includes an inner wall surface 30*a* on the downstream side, an inner wall surface 30*b* on the upstream side, and a bottom surface 30*c*. The depressed portion 30 is disposed using the reference surface RS as a reference. Specifically, the depressed portion 30 is disposed with the position of the bottom surface 30*c* low with respect to the reference surface RS. The lower end portion of the width adjustment guide 27 is positioned below with respect to the bottom surface 29*a* inside the chassis of the printer 1. That is, at least a part of the width adjustment guide 27 is housed in the depressed portion 30 in terms of the vertical direction (Y direction in FIG. 10).

The inner wall surfaces 30*a* and 30*b* of the depressed portion 30 are formed in an inclined state with respect to the bottom surface 29*a* inside the chassis.

The inner wall surface 30*a* on the downstream side is formed to get high gradually along the front-rear direction (X direction in FIG. 10). The inner wall surface 30*b* on the upstream side is formed to get low gradually along the front-rear direction (X direction in FIG. 10).

The lower end portion of the width adjustment guide 27 separates from the bottom surface 30*c* of the depressed portion 30 for a predetermined distance as illustrated in FIG. 10 and FIG. 11. The shape of the lower end portion of the width adjustment guide 27 may be an arc-shape, for example.

In other words, the lower end portion of the width adjustment guide 27 is positioned between the bottom surface 29*a* inside the chassis and the bottom surface 30*c* of the depressed portion 30 in terms of a perpendicular direction (Y direction in FIG. 10) with respect to the front-rear direction (X direction in FIG. 10).

As illustrated in FIG. 12 to FIG. 16, a part of the bottom surface 29*a* inside the chassis of the printer 1 and the inner surface of the depressed portion 30 (the inner wall surfaces 30*a* and 30*b*, and the bottom surface 30*c*) have a plurality of protrusions 31 extending along the front-rear direction (X direction in FIG. 12) formed in every predetermined interval along the width direction of the continuous paper P. This ensures the reduced contact area between the bottom surface 29*a* inside the chassis of the printer 1 (including the inner surface of the depressed portion 30) and the continuous paper P, thereby feeding the continuous paper P properly.

This also ensures the proper feeding of the continuous paper P, even in a case without liner sheet (that is, the adhesive of the label is exposed).

Furthermore, disposing the plurality of protrusions 31 can compensate the reduced mechanical strength of the bottom portion 29 inside the chassis of the printer 1 caused by the disposition of the depressed portion 30.

As illustrated in FIG. 14A to FIG. 16, a side edge 27*b* on the downstream side (F side in FIG. 14A to FIG. 16) of the width adjustment guide 27 is positioned in the front (that is, a side of the printing unit 11) with respect to the center A of the depressed portion 30 in terms of the front-rear direction (X direction in FIG. 14A to FIG. 16). That is, the side edge 27*b* of the width adjustment guide 27 is disposed in a position close to the inner wall surface 30*a* on the printing unit 11 side with respect to the inner wall surface 30*b* on a side of the paper sheet supply unit 10 of the depressed portion 30.

In FIG. 14A to FIG. 16, although an example where a side edge 27*a* on the upstream side also is positioned on the downstream side with respect to the center A of the depressed portion 30 as well as the side edge 27*b* on the downstream side of the width adjustment guide 27, the side edge 27*a* on the upstream side may position on the upstream side with respect to the center A of the depressed portion 30.

"[T]he center A of the depressed portion 30" means the center between an end 30*d* on the downstream side and an end 30*e* on the upstream side of the depressed portion 30. That is, a distance between the end 30*d* on the downstream side and the center A is equal to a distance between the end 30*e* on the upstream side and the center A.

"[T]he end of the depressed portion 30" is a point on the reference surface RS where the depressed portion 30 starts.

The inner wall surface 30*a* on the downstream side of the depressed portion 30 and the side edge 27*b* on the downstream side of the width adjustment guide 27 are separated for a shortest distance d (d>0). During the back feeding process, a deflection of the continuous paper P on the downstream side is larger than a deflection of the continuous paper P on the upstream side because the paper sheet supply unit 10 does not rotate but only the platen roller 23 rotates. Thus, deflected continuous paper P is easier to get through between the inner wall surface 30*a* on the downstream side of the depressed portion 30 and the side edge 27*b* on the downstream side of the width adjustment guide 27.

Therefore, in this embodiment, the side edge 27*b* of the width adjustment guide 27 is disposed in a position close to the inner wall surface 30*a* on the printing unit 11 side with respect to the inner wall surface 30*b* on the paper sheet supply unit 10 side of the depressed portion 30. It is preferable if the shortest distance d between the inner wall surface 30*a* on the downstream side of the depressed portion 30 and the side edge 27*b* on the downstream side of the width adjustment guide 27 is shorter.

Figure 14A:
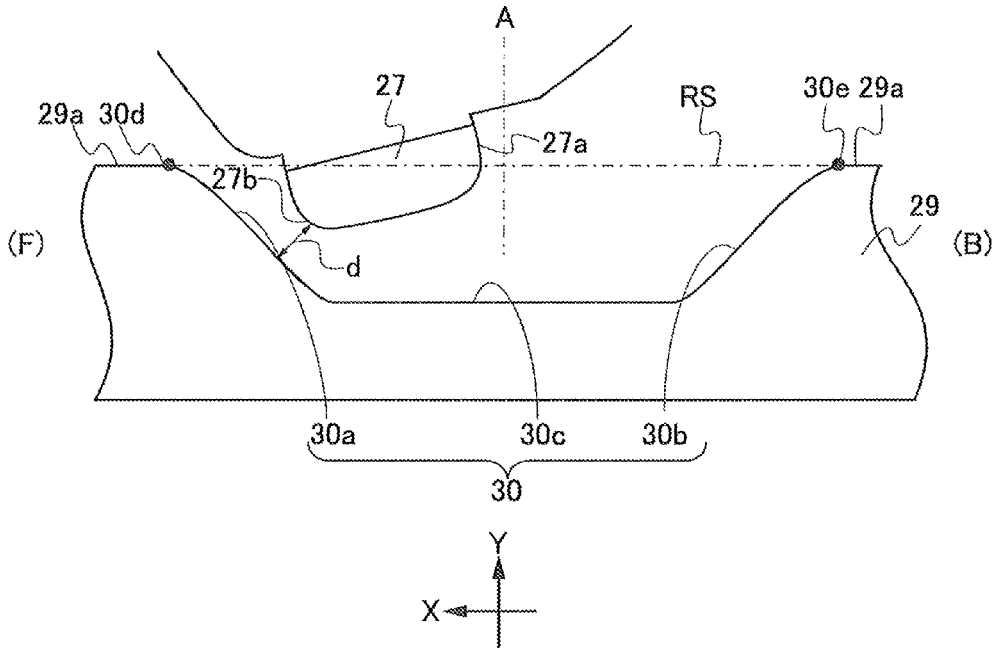
FIG. 14A is a main part enlarged view for illustrating one example of a positional relation between a width adjustment guide and a depressed portion in FIG. 10.

As illustrated in FIG. 14A, the inner wall surfaces 30*a* and 30*b* may include a radius portion having a predetermined curvature radius in the proximity of boundaries with the ends 30*d* and 30*e*, respectively. The inner wall surfaces 30*a* and 30*b* may include a curving portion (radius portion) having a predetermined curvature radius in the proximity of boundaries with the bottom surface 30*c* of the depressed portion 30, respectively. In this case, "the ends of the depressed portion 30" are the points of the radius ends on the reference surface RS in the radius portions of the inner wall surfaces 30*a* and 30*b*.

Figure 14B:
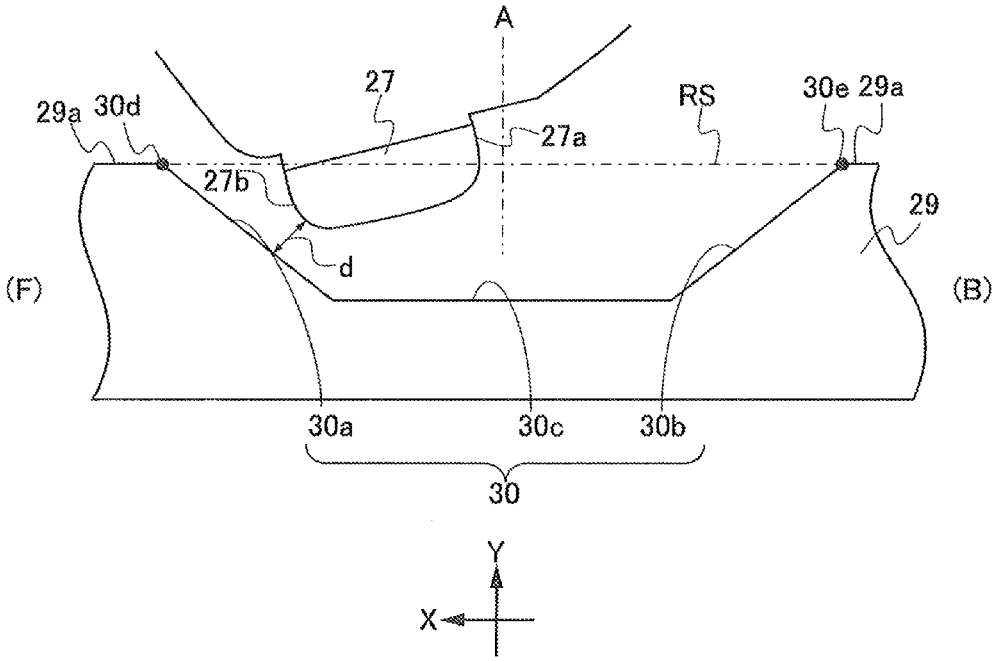
FIG. 14B is a main part enlarged view for illustrating one example of a positional relation between the width adjustment guide and the depressed portion in FIG. 10.

As illustrated in FIG. 14B, the inner wall surfaces 30*a* and 30*b* may be linear-shaped (flat surface) inclining with respect to the bottom surface 29*a* inside the chassis. In this case, "the ends of the depressed portion 30" are the intersection points of the inner wall surface 30*a* and the reference surface RS, and the inner wall surface 30*b* and the reference surface RS.

Figure 15A:
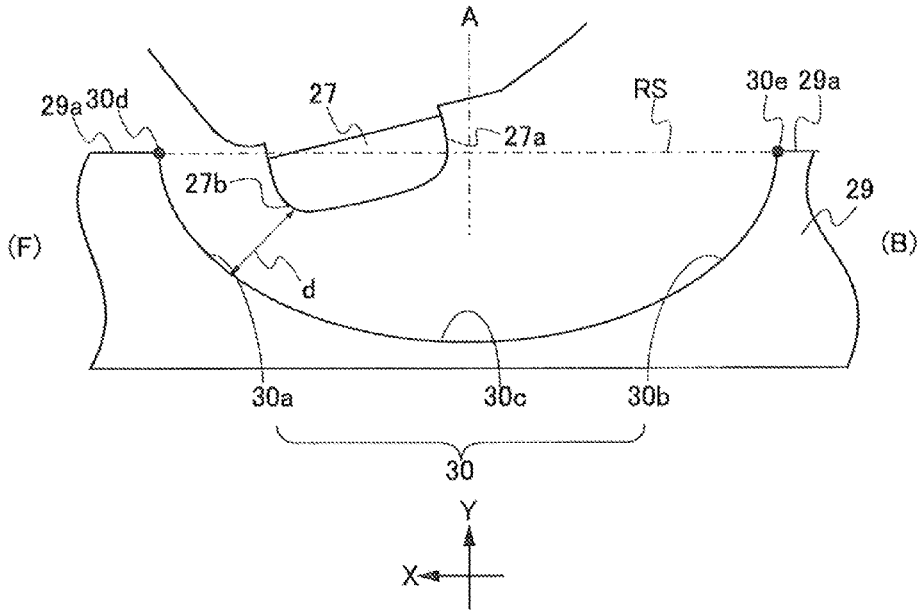
FIG. 15A is a main part enlarged view for illustrating one example of a positional relation between the width adjustment guide and the depressed portion in FIG. 10.

As illustrated in FIG. 15A, the depressed portion 30 may be arc-shaped having a predetermined radius. In this case, the inner wall surfaces 30*a* and 30*b*, and the bottom surface 30*c* of the depressed portion 30 are integrated. In this case, "the ends of the depressed portion 30" are the intersection points of the arc portion and the reference surface RS.

Figure 15B:
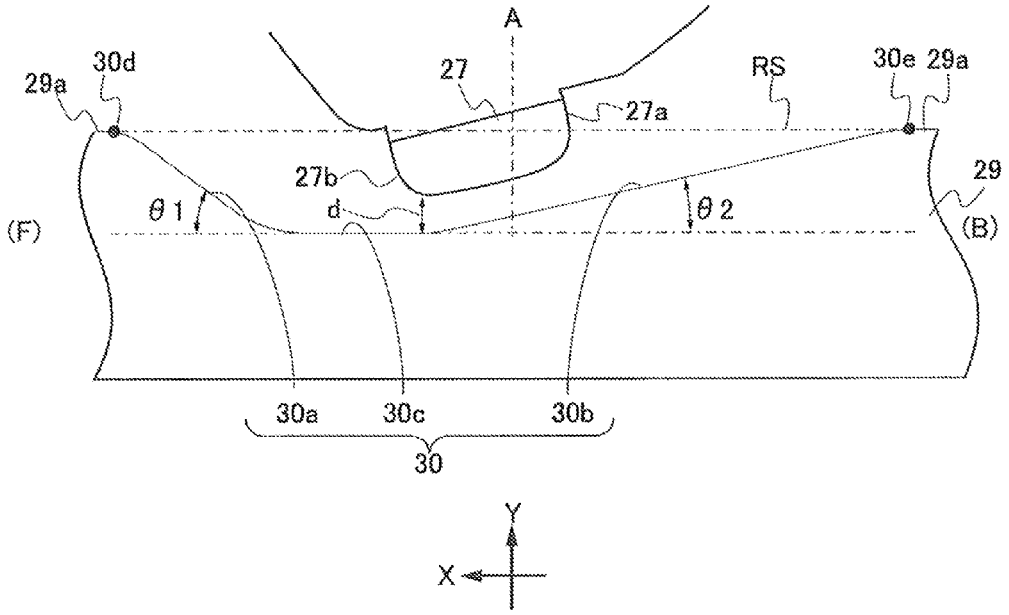
FIG. 15B is a main part enlarged view for illustrating one example of a positional relation between the width adjustment guide and the depressed portion in FIG. 10.

As illustrated in FIG. 15B, an angle θ1 formed by the inner wall surface 30*a* on the downstream side of the depressed portion 30 and the bottom surface 29*a* inside the chassis may be larger than an angle θ2 formed by the inner wall surface 30*b* on the upstream side of the depressed portion 30 and the bottom surface 29*a* (that is, it may be θ1>θ2).

In this case, during the printing process, the continuous paper P is fed along a feeding route that enters gradually to the damper portion 15 from the upstream side (B side in FIG. 10) and rises steeply to the damper portion 15 on the downstream side (F side in FIG. 10). This ensures the continuous paper P to be fed without contacting the inner wall surfaces 30*a* and 30*b*. In this case, "the ends of the depressed portion 30" are the intersection points of the inner wall surface 30*a* and the reference surface RS, and the inner wall surface 30*b* and the reference surface RS.

Figure 16:
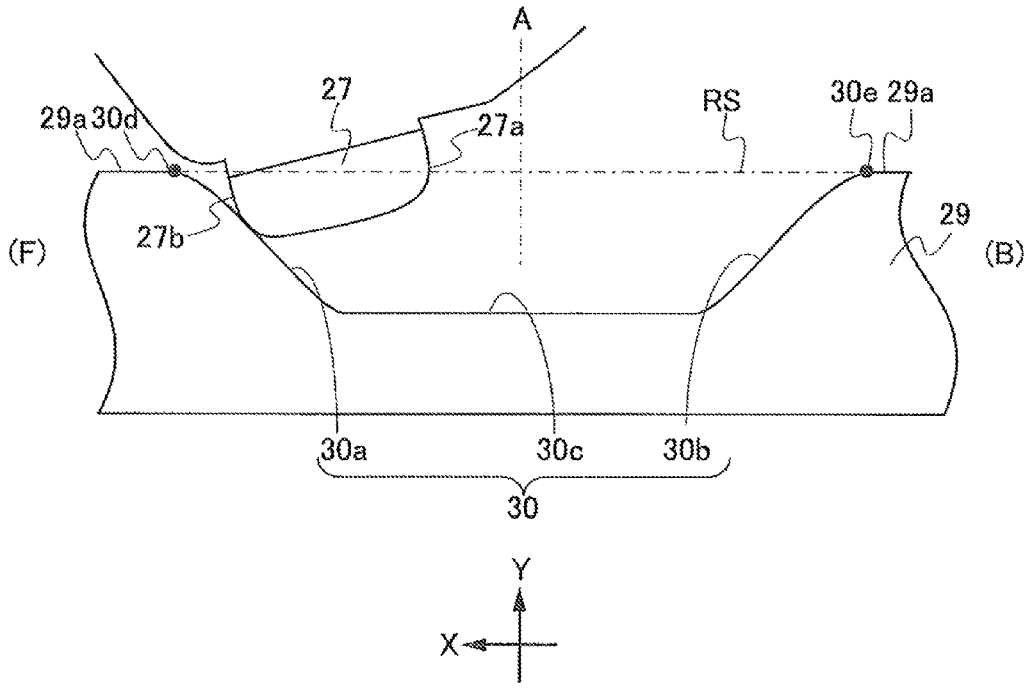
FIG. 16 is a main part enlarged view for illustrating one example of a positional relation between the width adjustment guide and the depressed portion in FIG. 10.

As illustrated in FIG. 16, abutting the side edge 27*b* on the downstream side of the width adjustment guide 27 to the inner wall surface 30*a* on the downstream side of the depressed portion 30, that is, d=0, is most preferable. This ensures solving a risk that the continuous paper P moves out of the guide range.

Furthermore, it is preferable that an elastic body is disposed on the inner wall surface 30*a* that abuts the side edge 27*b* on the downstream side of the width adjustment guide 27. This ensures avoiding damages of the side edge 27*b* and the inner wall surface 30*a* caused by the direct contact of the side edge 27*b* on the downstream side of the width adjustment guide 27 and the inner wall surface 30*a*. Also, the side edge 27*b* on the downstream side of the width adjustment guide 27 and the inner wall surface 30*a* can surely be abutted (that is, the shortest distance d is 0).

Figure 17A:
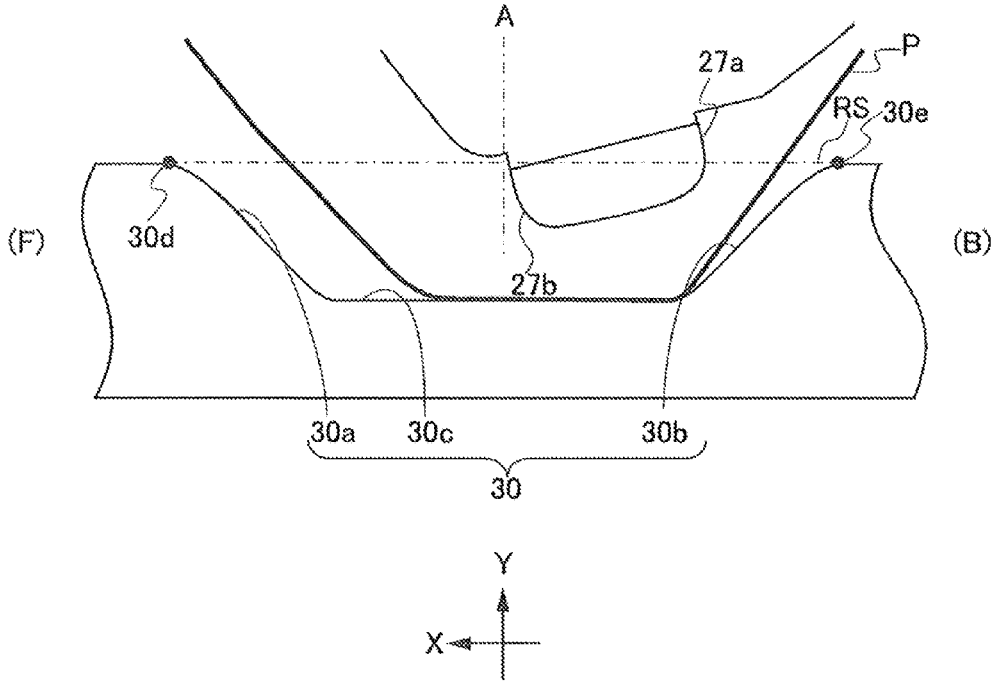
FIG. 17A is a main part enlarged side view of a damper of a printer as a comparative example during a back feeding process.
Figure 17B:
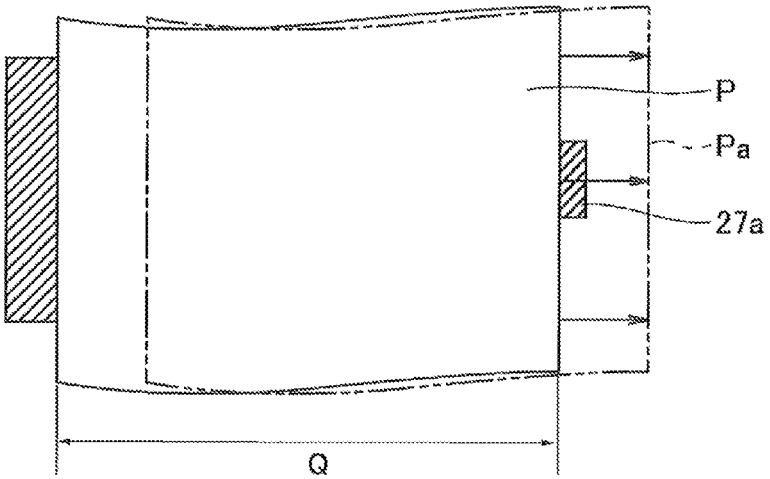
FIG. 17B is a plan view of the damper in FIG. 17A viewed from above.
Figure 18:
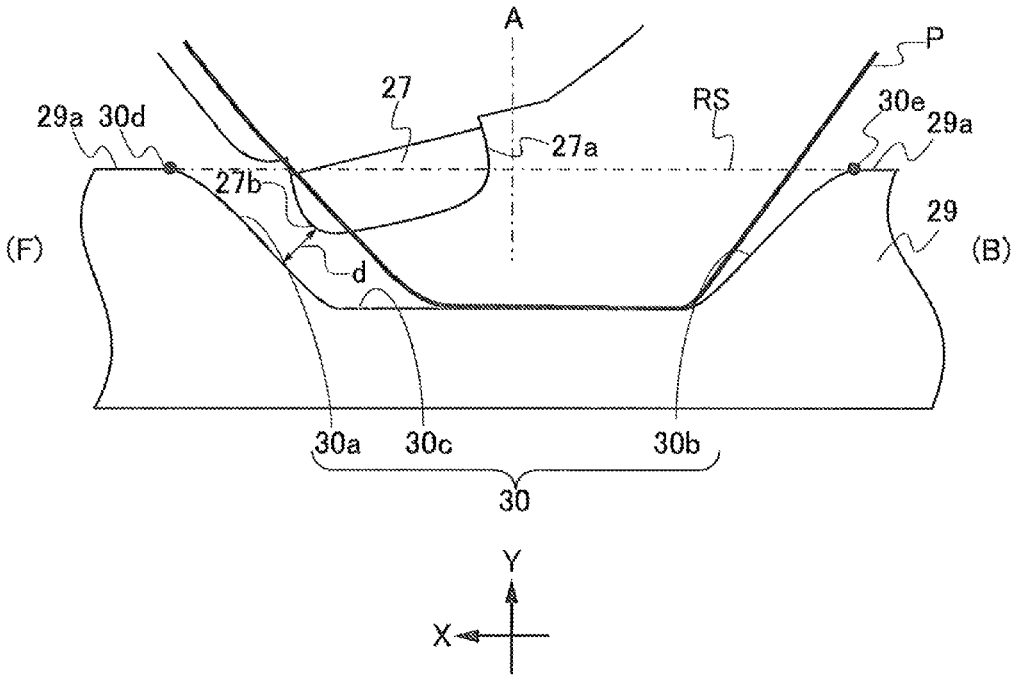
FIG. 18 is a main part enlarged side view of a damper of a printer according to the embodiment during the back feeding process.

(1-5) Comparison of the Embodiment with a Comparative Example (FIG. 17 and FIG. 18)

FIG. 17A is a main part enlarged side view of a damper of a printer of a comparative example during a back feeding process, and FIG. 17B is a plan view of the damper in FIG. 17A viewed from above. FIG. 18 is a main part enlarged side view of a damper of a printer according to the embodiment during a back feeding process.

As illustrated in FIG. 17A, the printer of the comparative example has not only the side edge 27*a* on the upstream side of the width adjustment guide 27 but also the side edge 27*b* on the downstream side positioned in the upstream side with respect to the center A.

In the comparative example, the continuous paper P deflects in a case where the continuous paper P is fed to the upstream side (B side in FIG. 17A) during the back feeding process. In this case, the deflection of a part that is positioned on the downstream side of the continuous paper P is larger than the deflection of a part that is positioned on the upstream side because the paper sheet supply unit 10 does not rotate, and only the platen roller 23 rotates.

When the continuous paper P deflects, the tension of the continuous paper P is lost, and the damper portion 15 can no longer bias the continuous paper P, thereby the continuous paper P moves away from the width adjustment guide 27 (that is, a state where the width adjustment guide 27 is not abutting with the side edge of the continuous paper P). Especially, by the continuous paper P deflecting significantly on the downstream side, the continuous paper P is more likely to move away from the width adjustment guide 27 on the downstream side than the upstream side (that is, high possibility of losing regulation of the widthwise move of the continuous paper P).

As a result, as illustrated in FIG. 17B, a continuous paper Pa (two-dot chain line) may move outside a guide range Q in the width direction of the continuous paper P. In this case, deterioration in printing quality such as deviation of a printing position from the planned position, and thinner printing density than the planned density, may be caused.

In contrast to this, in this embodiment, as illustrated in FIG. 18, the side edge 27*b* on the downstream side (F side in FIG. 18) of the width adjustment guide 27 is disposed at a position close to the inner wall surface 30*a* on the downstream side with respect to the inner wall surface 30*b* on the upstream side of the depressed portion 30 in the front-rear direction (X direction in FIG. 18).

This ensures the width adjustment guide 27 to abut on the side edge of the continuous paper P in the vertical direction (Y direction in FIG. 18) even though the continuous paper P deflects during the back feeding process (especially, even deflecting significantly on the downstream side).

As a result, the movement of the continuous paper P is restricted within the guide range in the width direction of the continuous paper P. Accordingly, deterioration in printing quality such as deviation of a printing position from the planned position, and thinner printing density than the planned density, can be prevented.

Especially, as illustrated in FIG. 16, in a case where the inner wall surface 30*a* on the downstream side of the depressed portion 30 and the side edge 27*b* on the downstream side of the width adjustment guide 27 contact, the width adjustment guide 27 can surely be abutted on the side edge of the continuous paper P on the downstream side where the continuous paper P deflects significantly. Accordingly, deterioration in printing quality such as deviation of a printing position from the planned position, and thinner printing density than the planned density, can reliably be prevented.

(1-6) Modifications of the Embodiment (FIG. 19A to FIG. 20B)

Figure 19A:
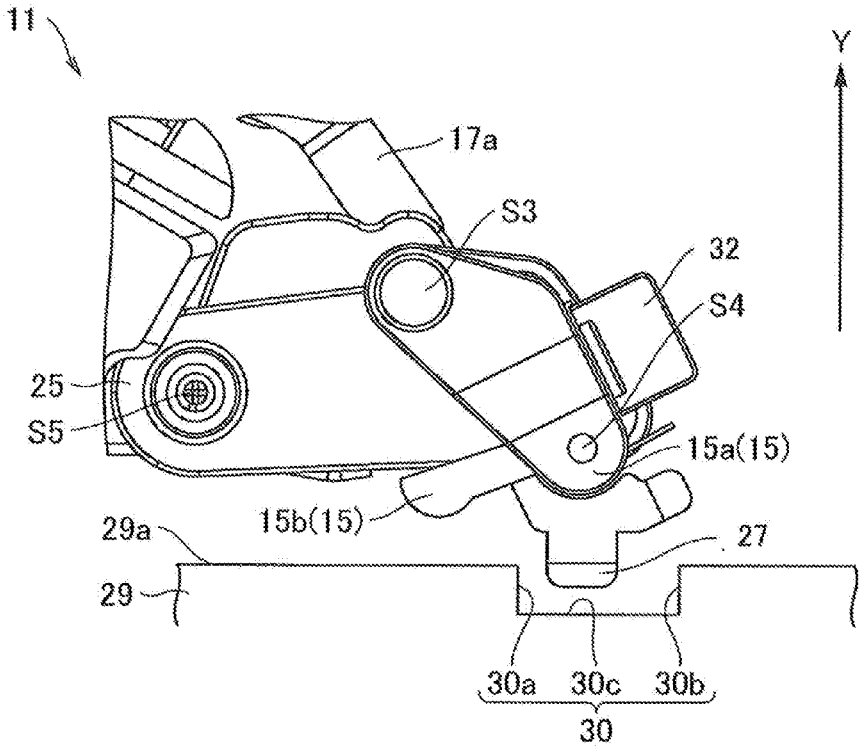
FIG. 19A is a main part enlarged side view of a damper according to a first modification of the embodiment.
Figure 19B:
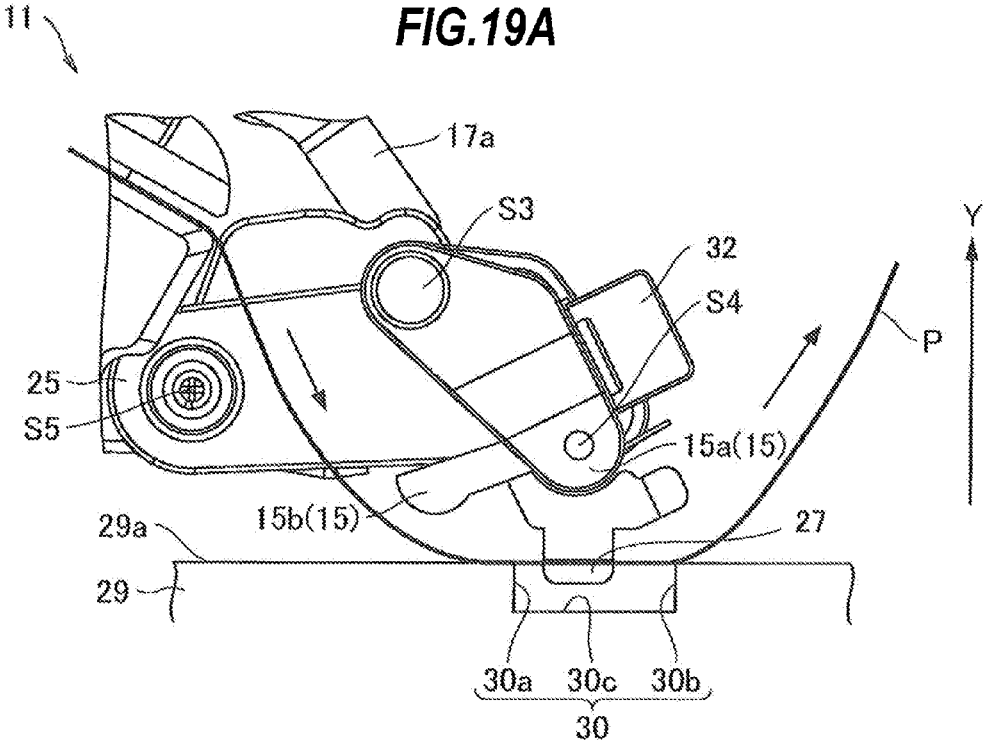
FIG. 19B is a main part side view of the damper in FIG. 19A during the back feeding process.

(1-6-1) A First Modification of the Embodiment (FIG. 19A and FIG. 19B)

A first modification of the embodiment will be described with reference to FIG. 19A and FIG. 19B. FIG. 19A is a main part enlarged side view of a damper according to a first modification of the embodiment, and FIG. 19B is a main part side view of the damper in FIG. 19A during a back feeding process.

In this embodiment, the example of the inner wall surfaces 30*a* and 30*b* of the depressed portion 30 are inclined has been described. In contrast to this, as illustrated in FIG. 19A, the first modification of the embodiment has the inner wall surfaces 30*a* and 30*b* of the depressed portion 30 that are not inclined, and are formed approximately vertical with respect to the bottom surface 29*a* inside the chassis of the printer 1.

In this case, as illustrated in FIG. 19B, it is hard for the continuous paper P to enter a lower side (Y direction in FIG. 19B) with respect to the bottom surface 29*a* during the back feeding process. Accordingly, with the first modification of the embodiment, the continuous paper P is unlikely to be out of the guide range compared with the embodiment.

Figure 20A:
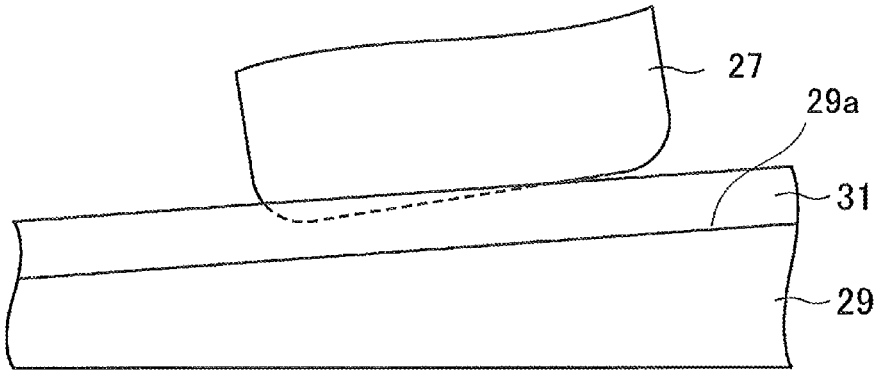
FIG. 20A is a main part enlarged side view of a width adjustment guide and a bottom portion of a chassis, of a printer according to a second modification of the embodiment.
Figure 20B:
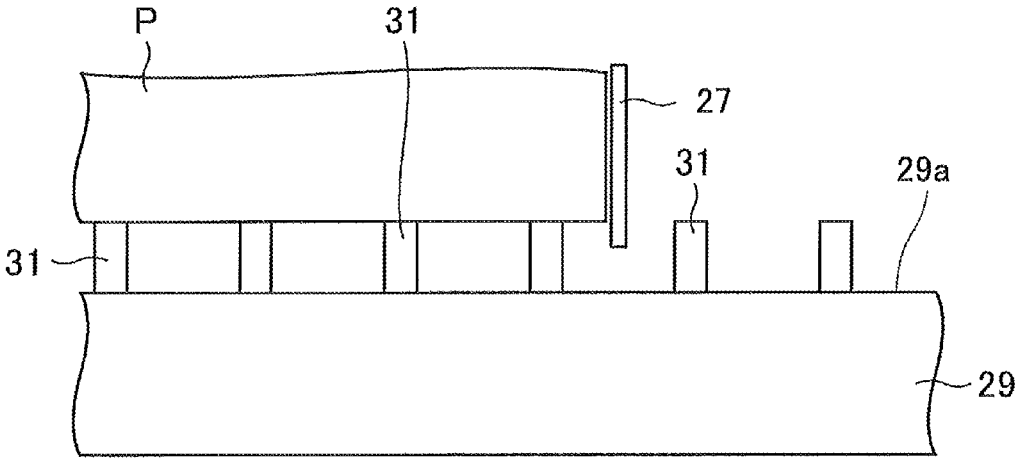
FIG. 20B is a main part enlarged front view where the width adjustment guide and the bottom portion of the chassis, of the printer in FIG. 20A are viewed from an anterior surface side.

(1-6-2) Second Modification of the Embodiment (FIG. 20A and FIG. 20B)

A second modification of the embodiment will be described with reference to FIG. 20A and FIG. 20B. FIG. 20A is a main part enlarged side view of a width adjustment guide and a bottom portion of a chassis, of a printer according to a second modification of the embodiment, and FIG. 20B is a main part enlarged front view where the width adjustment guide and the bottom portion of the chassis, of the printer in FIG. 20A are viewed from an anterior surface side.

In the second modification of the embodiment, as illustrated in FIG. 20A and FIG. 20B, the bottom of the width adjustment guide 27 is positioned between the bottom surface 29*a* of the chassis and the upper ends of the protrusions 31.

This positions the lower end of the width adjustment guide 27 in the lower side with respect to the continuous paper P, thus the continuous paper P moving out of the guide range can be prevented during the back feeding process.

The above-described embodiment described the example where the continuous paper P, which has the plurality of labels temporarily adhered on the liner sheet, is a print medium, however, the scope of the present invention is not limited to this. For example, the present invention is also applicable when a print medium is a continuous label having an adhesive surface on one side (a linerless label), a continuous seat not having an adhesive surface, or a medium which is not paper but printable by the thermal head (such as a film, for one example).

It should be noted that the above-described linerless label, continuous sheet, or medium other than paper may be disposed with the position detection marks.

When a linerless label or similar medium on which the adhesive is exposed is fed, the platen roller that includes silicone may be disposed as well as performing a non-adhesive coating on the feeding path.

(1-6-3) Other Modifications

In the above description, applying the present invention to a printer of a type that the operational panel 3 disposed on the printer 1 accepts an instruction from a user (what is called, a stand-alone type) has been described, however, the scope of the present invention is not limited to this.

The present invention is applicable to, for example, a printer of a type that a computer connected to the printer 1 accepts an instruction from a user, and the printer 1 accepts a control signal on the basis of this instruction from this computer (what is called, an online type).

The embodiment of the present invention has been described in detail, however, the present invention is not limited to the above-described embodiment. It is apparent that the above-described embodiment may be improved and changed in various ways within a range not departing from a spirit of the present invention. The technical matters described in the above-described embodiment and modifications are applicable by combination as necessary.

This application is based on and claims priority to Japanese Patent Application No. 2014-245215 filed in Japan Patent Office on Dec. 3, 2014, the entire content of which is incorporated herein by reference.

The invention claimed is:

1. A printer comprising:

a medium supply unit configured to supply a print medium;

a printing unit configured to print predetermined information on the print medium;

a feed unit configured to feed the print medium along a feed direction that is any one of a first direction toward the printing unit from the medium supply unit, and a second direction toward the medium supply unit from the printing unit, on a reference surface;

a depressed portion disposed using the reference surface as a reference; and a movement restricting portion including a guide piece, the movement restricting portion being configured to restrict a movement of the print medium to a direction perpendicular to the feed direction of the print medium by housing at least a part of the guide piece in the depressed portion, and abutting a side edge of the print medium on the guide piece, wherein a side edge on a side of the printing unit of the guide piece is disposed at a position close to an inner wall surface on the printing unit side of the depressed portion with respect to an inner wall surface on a side of the medium supply unit of the depressed portion.

2. The printer according to claim 1, wherein the side edge on the printing unit side of the guide piece abuts on the inner wall surface on the printing unit side of the depressed portion.

3. The printer according to claims 1, further comprising, a damper portion disposed between the printing unit and the medium supply unit, the damper portion being configured to give tension to the print medium, wherein the movement restricting portion is disposed in the damper portion.

4. The printer according to claim 3, wherein:

the damper portion includes an inner damper portion, and a position where the inner damper portion abuts on the print medium is positioned on a downstream side with respect to a position of the depressed portion in the first direction.

* * * * *